US005829922A

United States Patent [19]

Calandra, Jr. et al.

[11] Patent Number: 5,829,922

[45] Date of Patent: Nov. 3, 1998

[54] CABLE BOLT HEAD

[75] Inventors: Frank Calandra, Jr.; Eugene H. Stewart, both of Pittsburgh; Stanley Ponce, Cresson; John G. Oldsen, Butler; John C. Stankus, Canonsburg, all of Pa.; Brian R. Castle, Rolla, Minn.; Robert Nestor, Albright, W. Va.

[73] Assignee: Jenmar Corporation, Pittsburgh, Pa.

[21] Appl. No.: 652,791

[22] Filed: May 23, 1996

Related U.S. Application Data

[63] Continuation-in-part of Ser. No. 585,319, Jan. 11, 1996.

[51] Int. Cl.[6] ..... E21D 21/00

[52] U.S. Cl. ..... 405/302.2; 405/259.1

[58] Field of Search ..... 405/302.2, 259.1, 405/259.2, 259.3, 259.4, 259.5, 259.6

[56] References Cited

U.S. PATENT DOCUMENTS

| | | | |
|---|---|---|---|
| 3,077,809 | 2/1963 | Harding et al. | 85/2.4 |
| 3,226,934 | 1/1966 | Emery | 61/45 |
| 3,394,527 | 7/1968 | McLean | 52/741 |
| 3,507,121 | 4/1970 | Morfeldt | 61/39 |
| 3,971,177 | 7/1976 | Endo | 52/166 |
| 4,247,225 | 1/1981 | Chickini, Jr. et al. | 405/260 |
| 4,265,571 | 5/1981 | Scott | 405/259 |
| 4,378,180 | 3/1983 | Scott | 405/259 |
| 4,472,088 | 9/1984 | Martin | 405/259 |
| 4,531,861 | 7/1985 | Kash | 405/261 |
| 4,784,531 | 11/1988 | Calandra, Jr. | 405/261 |
| 4,798,501 | 1/1989 | Spies | 405/260 |
| 4,832,534 | 5/1989 | Duvieusart | 405/261 |
| 4,866,903 | 9/1989 | Ferstay | 52/677 |
| 4,896,416 | 1/1990 | Cranko et al. | 29/522.1 |
| 5,113,634 | 5/1992 | Lüthi | 52/741 |
| 5,230,589 | 7/1993 | Gillespie | 405/259.6 |
| 5,253,960 | 10/1993 | Scott | 405/302.2 |
| 5,259,703 | 11/1993 | Gillespie | 405/259.6 |
| 5,288,176 | 2/1994 | Huff et al. | 405/259.6 |
| 5,375,946 | 12/1994 | Locotos | 405/259.4 |
| 5,378,087 | 1/1995 | Locotos | 405/259.5 |
| 5,415,498 | 5/1995 | Seegmiller | 405/288 |
| 5,417,521 | 5/1995 | Scott | 405/259.6 |
| 5,462,391 | 10/1995 | Castle et al. | 405/302.2 |
| 5,466,095 | 11/1995 | Scott | 405/302.2 |
| 5,511,909 | 4/1996 | Calandra, Jr. et al. | 405/259.1 X |
| 5,570,976 | 11/1996 | Fuller et al. | 405/302.2 |
| 5,586,839 | 12/1996 | Gillespie | 405/302.2 X |

OTHER PUBLICATIONS

Dywidag Systems International. USA, Inc.: Dywidag Passive Cable Bolt publication: Feb. 1994: 1 Sheet.

Stephen C. Tadolini and Jamie L. Gallagher: *Cable Bolts for Longwall Gate Entry Support:* pp. 77–89.

*Primary Examiner*—Tamara L. Graysay
*Assistant Examiner*—Frederick L. Lagman
*Attorney, Agent, or Firm*—Webb Ziesenheim Bruening Logsdon Orkin & Hanson, P.C.

[57] ABSTRACT

A plurality of designs for mine roof bolts is disclosed. Each mine roof bolt includes a flexible multi-strand cable having a first and second end with a drivehead formed on the first end, the drivehead having a plurality of driving faces on an exterior surface thereof. The drivehead is a separate member. A barrel and wedge assembly is attached to the cable wherein the drivehead is utilized substantially for rotating the cable.

25 Claims, 4 Drawing Sheets

CABLE BOLT HEAD

The present application is a continuation-in-part of co-pending U.S. patent application Ser. No. 08/585,319 filed on Jan. 11, 1996 entitled "CABLE BOLT HEAD".

BACKGROUND OF THE INVENTION

1. Field of the Invention

The present invention relates to cable mine rock anchors, such as roof bolts. Specifically, the present invention relates to flexible mine roof bolts utilizing a multi-strand cable and which are adapted to be rotated in the borehole by a drivehead at a first end thereof.

2. Description of the Prior Art

Flexible cable bolts and cable systems have been utilized in the construction and mining industries since about 1970. More recently, cable mine roof bolts have been utilized as a roof control in the mining industry with both resin grouting and more conventional cement grouting techniques. Examples of cable mine roof bolts utilized in resin grouting applications can be found in U.S. Pat. Nos. 5,230,589 to Gillespie; 5,259,703 to Gillespie; 5,375,946 to Locotos; and WIPO Publication No. WO 93/03256 to Fuller et al. All of these mine roof bolt designs incorporate some type of drivehead assembly for rotating the cable bolt. All of these prior art systems suffer from various drawbacks.

The mine roof bolt disclosed in the Gillespie patents replaces a tubular barrel of a conventional barrel and wedge assembly with a specially machined hexagonal head collar. The hexagonal head collar must necessarily be large enough to receive the internal wedges therein which make the head collar too large to be driven with conventional bolting equipment. Consequently, in addition to the special machining of the hexagonal drivehead, the Gillespie patents require the use of specialized adapters by the bolting equipment to accommodate the enlarged hexagonal head.

WIPO Publication No. WO 93/03256 and the Locotos patent disclose cable mine roof bolts which utilize a hex nut attached to the end thereof to both rotate the cable bolt and support the bearing plate. The WIPO publication discloses inclusions of threads on at least one of the strands of the cable so that the hex nut can be threaded directly onto the cable. The Locotos patent utilizes a collar having a threaded end which is attached to the cable with the hex head threaded onto the collar. These designs require the attachment of the hex nut to the cable to meet the loading capacity of the cable bolt since the driveheads also serve to support the bearing plate.

It is the object of the present invention to provide a mine roof bolt design which overcomes the disadvantages of the above-described prior art. It is a further object of the present invention to provide a mine roof bolt design which can be utilized with conventional roof bolting equipment. A further object of the present invention is to provide a mine roof bolt which is easy and economical to manufacture.

SUMMARY OF THE INVENTION

The objects of the present invention are achieved by providing a mine roof bolt which includes a flexible multi-strand cable, a barrel and wedge assembly attached to the cable between first and second ends thereof and a drivehead attached to the multi-strand cable at a position spaced along the cable from the barrel and wedge assembly with the drivehead having a plurality of driving faces on an exterior surface thereof.

The drivehead may be positioned adjacent the barrel and wedge assembly wherein the drivehead extends less than 1" beyond the barrel and wedge assembly. Alternatively, the mine roof bolt may further include a sleeve member surrounding the cable which is formed integrally with the drivehead. The sleeve member may be positioned to extend partially into the barrel of the barrel and wedge assembly. The sleeve member may be attached to the cable by press fitting, swaging, adhesives, welding, or combinations thereof. Additionally, the drivehead may include a central bore therethrough for receiving the cable. In one embodiment of the present invention, the borehole extends through the drivehead such that the cable can extend through and beyond the drivehead to provide for post tensioning of the cable bolt after installation. The drivehead may be secured to the cable by press fitting or the use of adhesives or a cable spreading wedge or a combination thereof. For a press fitting connection, internal threads or ridges may be provided in the drivehead and/or the sleeve member to provide sufficient frictional engagement with the cable. With adhesives, metal filings or powder may be used, and the inner diameter of the drivehead and/or the sleeve member may be knurled or roughened to increase the bonding strength. With a cable spreading wedge, the wedge may be inserted into a first end of the cable which is received within the bore of the drivehead. The cable spreading wedge will bias the outer strands of the cable against the drivehead to secure the cable to the drivehead.

These and other advantages of the present invention will be clarified in the brief description of the preferred embodiments wherein like reference numerals represent like elements throughout.

BRIEF DESCRIPTION OF THE PREFERRED EMBODIMENTS

Figure 1A:
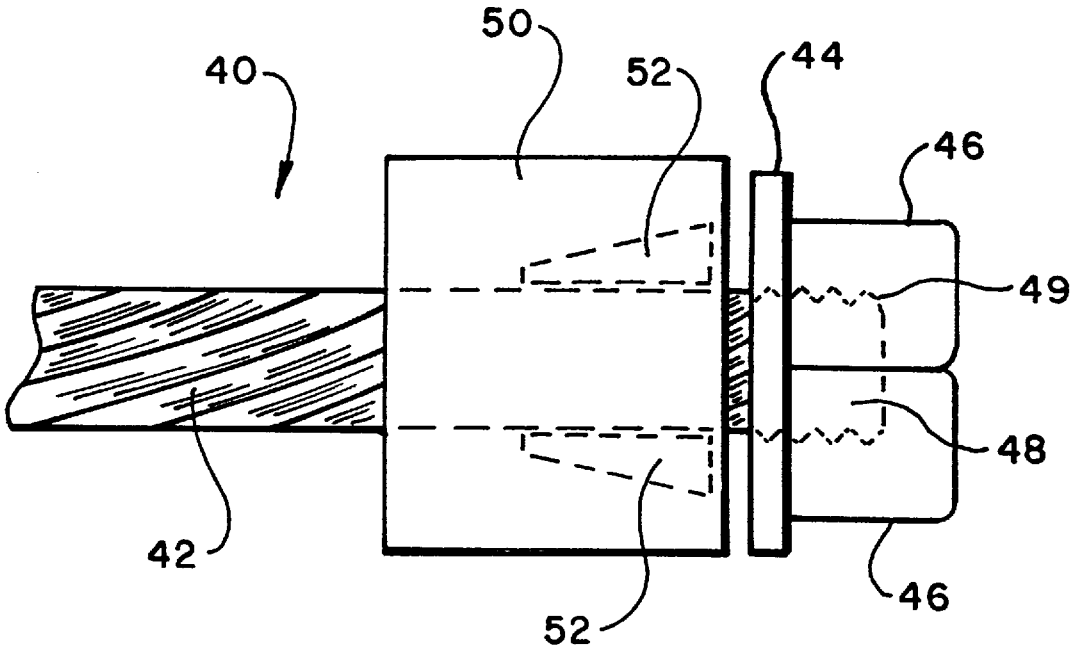
FIG. 1*a* is a side view of a cable mine roof bolt according to a first embodiment of the present invention.
Figure 1B:
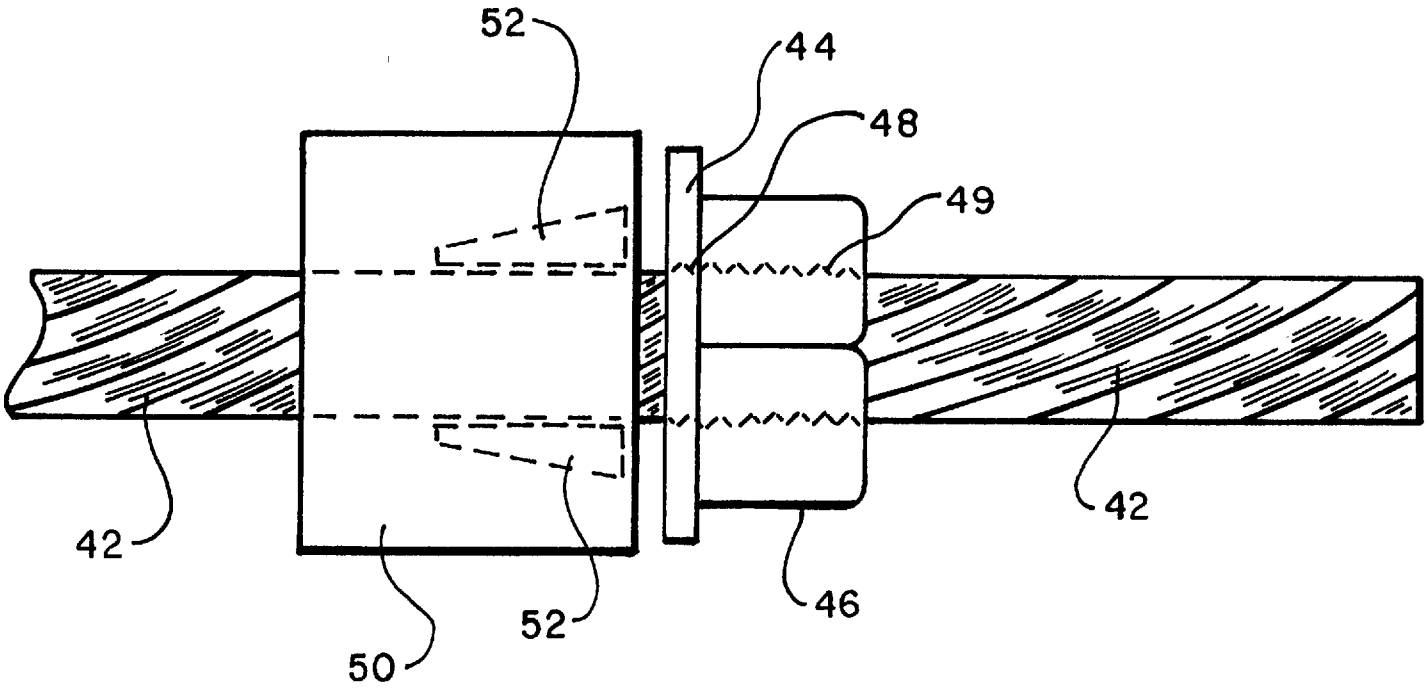
FIG. 1*b* is a side view of a modified cable mine roof bolt according to the first embodiment of the present invention.
Figure 2:
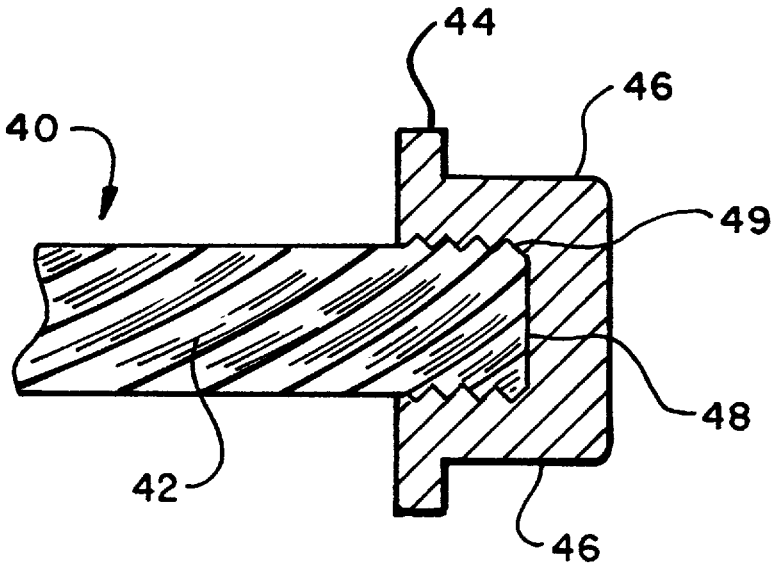
FIG. 2 is a enlarged sectional view of a cable bolt head of the cable mine roof bolt illustrated in FIG. 1*a;*

FIGS. 1*a*, 1*b* and 2 illustrate a cable mine roof bolt 40 according to the present invention. The mine roof bolt 40 includes a central cable 42 which is adapted to be received into a borehole. The cable 42 is preferably standard seven-wire cable which is described in ASTM designation A 416 entitled "Standard Specification for Steel Strand, Uncoated Seven-Wire for Prestressed Concrete". Alternatively, galvanized seven-wire cable is also utilized and is described in ASTM designation A 586. The galvanized cable presents additional concerns which will be described hereinafter. The cable 42 is preferably of a seven-strand type which has a center or king strand enclosed tightly by six helically wound outer strands with a uniform pitch of between twelve and sixteen times the nominal diameter of the cable. The cable 42 generally comes in grades determined by the minimum ultimate strength of the cable. For example, Grade 250 has a minimum ultimate strength of 250,000 psi and Grade 270 has a minimum ultimate strength of 270,000 psi. Additionally, bird cages may be incorporated into the length of the cable 42 at selected positions thereon. Similarly, buttons can be swaged onto the cable 42 at spaced positions thereon. The bird cages and buttons help improve the mixing of the resin as well as increase the bond strength of the attachment as is known in the art.

At a first end of the cable 42 is an attached, separate drivehead 44. The drivehead 44 includes four planar driving faces 46 formed on an exterior surface thereof. The four driving faces 46 form a substantially 1" square drivehead on the drivehead 44. The drivehead 44 may include a flange formed in front of the driving faces 46.

The drivehead 44 includes a central bore 48 therein for receiving the first end of the cable 42. The central bore 48 may extend partially through the drivehead 44, as shown in FIG. 1*a*, or entirely therethrough, as shown in FIG. 1*b*. Additionally, the central bore 48 is preferably straight, but may be tapered.

The central bore 48 includes threads 49 which help in press fitting of the drivehead 44 to the cable 42. The inner diameter of the central bore 48 and threads 49 must be selected to very closely match the outer diameter of the cable 42 for effective press fitting. A maximum inner diameter of 0.551" for the central bore 48 and threads 49, and a pitch of 0.57"–0.58" has been found to work effectively with standard sized regular or galvanized cable. Alternative to threads 49, similarly sized ridges or other types of projections may be formed in the central bore 48. However, threading of the central bore 48 may represent the easiest method of forming appropriately sized projections.

The drivehead 44 can also be attached to a non-galvanized cable 42 by use of resin adhesives or the like used alone or in combination with the press fit described above. The galvanized cable 42, however, has been found to not consistently bond with conventional adhesives. The adhesives may include metal filings or metal powder mixed therein to increase the bonding strength thereof. Additionally, the central bore 48 of the drivehead 44 may be roughened to increase bond strength. Small diameter pins or pilot holes (not shown) may extend into the central bore 48 transversely thereto. Transverse pilot holes may be used to supply additional adhesives into the central bore 48 after the cable is positioned therein. Additionally, the cured adhesive extending into the pilot holes may increase the torsional strength of the connection between the drivehead 44 and the cable 42.

The mine roof bolt 40 additionally includes a barrel and wedge assembly adjacent the drivehead 44. The barrel and wedge assembly includes a substantially tubular barrel 50 and internal locking wedges 52 which surround and securely grip onto the cable 42. The barrel and wedge assembly is a conventional, well-known and accepted mechanism for receiving the loading requirements of a mine roof bolt. In operation, the barrel 50 will be adjacent and will support a bearing plate. The drivehead 44 is only utilized for rotating the mine roof bolt 40 during resin grouting installation. Consequently, the attachment of the drivehead 44 to the cable 42 needs only be sufficiently strong to receive the torque in turning of the mine roof bolt 40. The torque exerted on drivehead 44 during a typical resin grouted installation procedure would generally be less than 100 ft.-lbs. However, due to the handling and transportation conditions which the mine roof bolt 40 undergoes in movement to the borehole, a minimum of 150 ft.-lbs. is desired for the torque strength of the connection between the drivehead 44 and the cable 42. The use of resin adhesives alone to connect drivehead 44 to standard non-galvanized cable 42 has been found to have an ultimate torque strength of about 160–170 ft.-lbs. The addition of the metal filings or powder with the adhesives increases the ultimate torque strength of the connection between the non-galvanized cable 42 and the drivehead 44 to about 300 ft.-lbs. The use of adhesives alone has been found to be inconsistent with the galvanized cable. The press fit connection between the drivehead 44 and the cable 42 has been found to provide ultimate torque strength values of about 450 ft.-lbs for both galvanized and non-galvanized cables 42. The combination of the press fit connection and adhesives would be expected to provide even greater ultimate torque strength.

The mine roof bolt 40 is specifically designed to have a minimal profile of less than about 1" beyond the barrel and wedge assembly. Consequently, the drivehead 44 preferably abuts the barrel 50 to minimize this profile. However, the present invention maintains the drivehead 44 as separate from the barrel and wedge assembly 50. The minimum profile of the mine roof bolt 40 is an important requirement in the confined spaces of a mining environment.

FIG. 1*b* illustrates a mine roof bolt 40 in which the central bore 48 extends through the drivehead 44 such that the cable 42 can extend through the drivehead 44 as shown. Having a length of cable, such as about 6", extending from the drivehead 44 allows for post tensioning of the cable mine roof bolt 40. Hollow sockets on bolting machines can accommodate a length of cable, such as 6", extending beyond the drivehead 44. After the cable mine roof bolt 40 is spun and set into position (i.e., after the resin has been mixed and cured), the length of cable extending beyond the drivehead 44 can be used for tensioning of the cable bolt with known hydraulic cable tensioners. Where seam height is at issue, the length of cable beyond the drivehead 44 may be removed after tensioning of the cable mine roof bolt 40. The drivehead 44 may also be removed at this point since the cable mine roof bolt 40 has already been spun.

Figure 3:
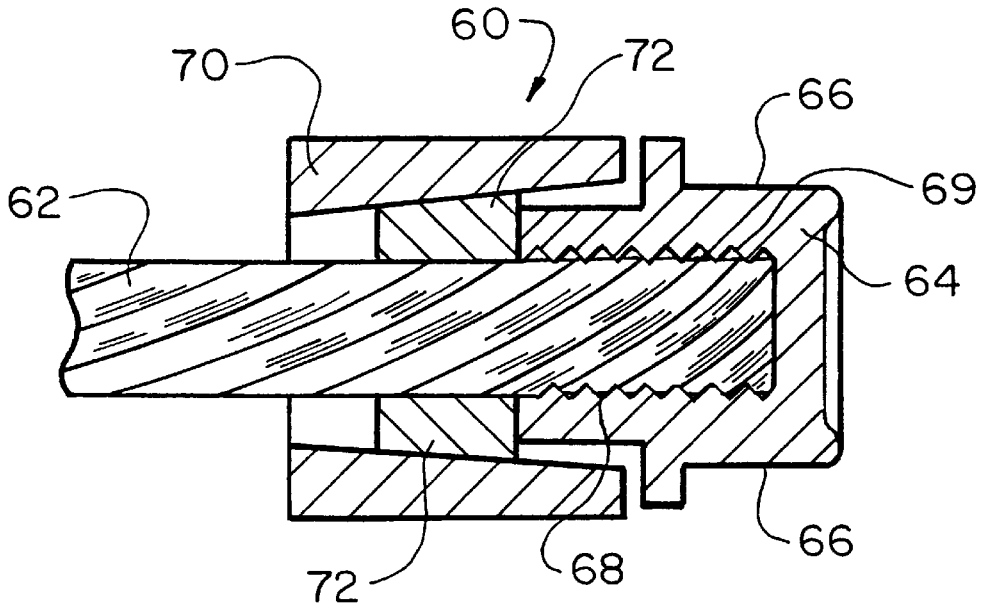
FIG. 3 is a side view, partially in section, of a second embodiment of the present invention.

FIG. 3 illustrates a mine roof bolt 60 according to a second embodiment of the present invention. The mine roof bolt 60 is substantially similar to the mine roof bolt 40 and includes a cable 62, drivehead 64 with driving faces 66 and central bore 68. A barrel and wedge assembly is provided with barrel 70 and locking wedges 72 surrounding the cable 62. The mine roof bolt 60 differs from mine roof bolt 40 in two respects. First, the drivehead 64 includes an integral sleeve member 74 which surrounds the cable 62, and threads 69 extend up the central bore 68 into the interior of the sleeve member 74. As with threads 49 discussed above, the threads 69 act as projections forming a tight press fit with the cable 62. The sleeve member 74 allows the drivehead 64 to be attached to the first end of the cable 62 by press fitting, swaging, adhesives, or combinations thereof. As described above, metal powder or filings may be incorporated into the adhesives increasing the bonding strength thereof as well as roughing of the interior of the sleeve member 74. The addition of the sleeve member 74 allows for swaging the sleeve member 74 and associated, integral drivehead 64 to the cable 62. Additionally, the length of the sleeve member 74 can be selected to achieve the appropriate bonding needed between the drivehead 64 and the cable 62 by press fitting, adhesives and/or swaging. An increase in the length of the sleeve member 74 will correspond to an increase in the bonding strength therebetween in the press fitting, adhesives and/or swaging operations discussed. An additional distinction between the mine roof bolt 60 and the mine roof bolt 40 is that the locking wedges 72 have been decreased in length so that the sleeve member 74 can be received, in part, within the barrel 70. This construction minimizes the overall profile of the mine roof bolt 60 below the barrel and wedge assembly.

Figure 4:
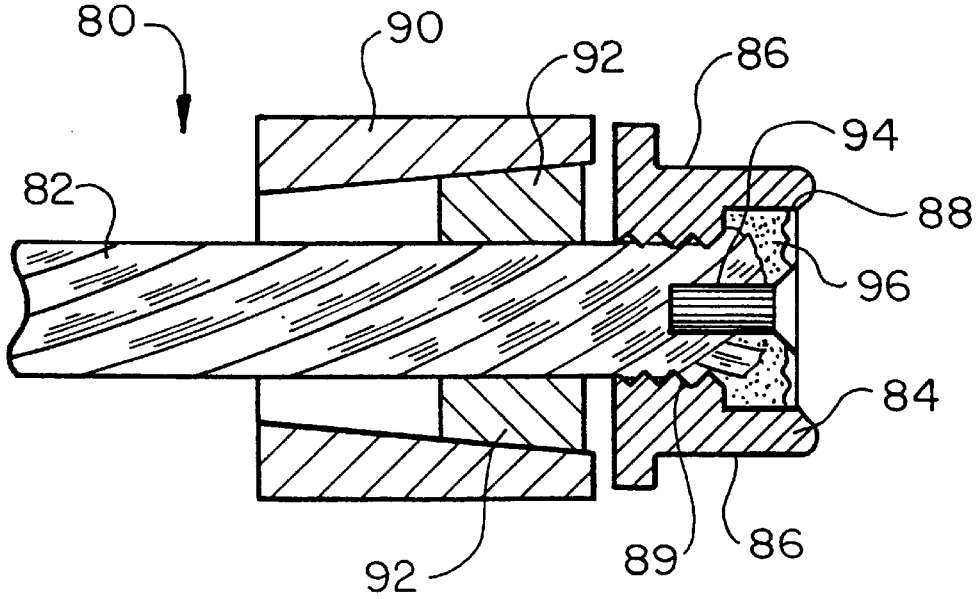
FIG. 4 is a side view, partially in section, of a third embodiment of a cable mine roof bolt according to the present invention.

FIG. 4 illustrates a mine roof bolt 80 according to a third embodiment of the present invention. The mine roof bolt 80 is substantially similar to mine roof bolts 40 and 60 described above and includes a cable 82, drivehead 84 with driving faces 86 and central bore 88 and a barrel and wedge assembly comprised of barrel 90 and locking wedges 92. The mine roof bolt 80 differs from mine roof bolt 40 shown above in that the central bore 88 extends through the drivehead 84. Threads 89 may be provided in at least part of the central bore 88 for press fitting. Additionally, a cable spreading wedge 94 is driven into the first end of the cable 82 to bias the outer peripheral strands of the cable 82 against the drivehead 84 to secure the drivehead 84 to the cable 82. Additionally, molten metal 96 is poured onto the outer end of the central bore 88 to further secure the cable 82 to the drivehead 84. The cable spreading wedge 94 and metal 96 may be used in conjunction with adhesives on the internal portions of the bore 88 as described above in connection with mine roof bolt 40. Additionally, the outer end of the central bore 88 may be stepped or even flared out to provide for a more secure attachment of the drivehead 84. Similar to the mine roof bolts 60 and 40 described above in mine roof bolt 80, the connection of the drivehead 84 to the cable 82 needs only be sufficiently strong to receive the rotational forces imposed during turning. This feature is a result of having the drivehead 84 separate from the load-receiving elements of the cable mine roof bolt 80. The loading requirements will be achieved by the conventional barrel and wedge assembly.

In all of the embodiments described above, the driveheads fit conventional bolting equipment without requiring additional adapters. Additionally, the driveheads are easily incorporated onto the mine roof bolt.

It will be apparent to those of ordinary skill in the art that various changes and modifications may be made to the present invention without departing from the spirit and scope thereof. Consequently, the scope of the present invention is intended to be defined by the attached claims.

What is claimed is:

1. A mine roof bolt comprising:

a flexible multi-strand cable having a first end and a second end;

a barrel and wedge assembly forming a load-bearing member for said mine roof bolt and directly attached to said cable between said first end and said second end; and a drive head directly attached to said multi-strand cable at a position spaced along said cable from said attachment of said barrel and wedge assembly and said cable, said drive head having a plurality of driving faces on an exterior surface thereof.

2. The mine roof bolt of claim 1 further including a sleeve member surrounding said cable formed integrally with said drivehead.

3. The mine roof bolt of claim 2 wherein said sleeve member extends partially into said barrel of said barrel and wedge assembly.

4. The mine roof bolt of claim 2 wherein said sleeve member is swaged onto said cable.

5. The wedge assembly of claim 2 wherein said sleeve member is attached to said cable by adhesives.

6. The mine roof bolt of claim 1 wherein said drivehead includes a central bore which receives said cable.

7. The mine roof bolt of claim 6 wherein said bore extends longitudinally through said drivehead.

8. The mine roof bolt of claim 7 further comprising a cable spreading wedge inserted into said first end of said cable with said first end of said cable positioned within said bore of said drivehead, wherein said cable spreading wedge biases outer strands of said multi-strand cable against said drivehead to secure said drivehead to said cable.

9. The mine roof bolt of claim 6 further including projections formed in said central bore.

10. The mine roof bolt of claim 9 wherein said projections are threads formed in said central bore which engage in a press fit connection.

11. The mine roof bolt of claim 1 wherein said drivehead is positioned adjacent said barrel and wedge assembly wherein said drivehead extends less than 1" beyond said barrel and wedge assembly.

12. The mine roof bolt of claim 1 wherein four said planar driving faces are provided forming a square drive head and wherein each said planar driving face is about one inch in length.

13. The mine roof bolt of claim 12 wherein said drive head is attached to said cable by adhesive.

14. The mine roof bolt of claim 13 wherein said drive head abuts said barrel and wedge assembly and wherein said drive head extends less than one inch beyond said barrel and wedge assembly.

15. A flexible mine roof bolt comprising:

a flexible multi-stand cable having at least one core strand and a plurality of peripheral strands helically wound around said at least one core strand;

a barrel and wedge assembly forming a load-bearing member for said mine roof bolt and directly attached to said cable; and a drive head directly attached to said cable at a distal end thereof at a position spaced alone said cable from said direct attachment of said barrel and wedge assembly to said cable, said drive head adjacent said barrel and wedge assembly, said drive head having a central bore extending therein for receiving said distal end of said cable, said drive head having a plurality of substantially planar driving faces on an exterior surface thereof, wherein rotation of the drive head will impart rotation directly to said cable and said drive head is a non-load-bearing member for said mine roof bolt.

16. The mine roof bolt of claim 15 further including projections formed in said central bore.

17. The mine roof bolt of claim 16 wherein said projections are threads formed in said central bore which engage said cable in a press fit connection.

18. The mine roof bolt of claim 17 wherein said strands of said flexible cable are galvanized.

19. The mine roof bolt of claim 15 wherein said central bore extends through said drivehead and said cable extends beyond said drivehead.

20. The mine roof bolt of claim 15 wherein four said planar driving faces are provided for forming a square drive head.

21. The mine roof bolt of claim 20 wherein each said planar driving faces is about one inch in length.

22. The mine roof bolt of claim 15 wherein said drive head is attached to said cable by adhesive.

23. The mine roof bolt of claim 22 wherein said adhesive includes a metal filler to increase the bonding strength thereof.

24. The mine roof bolt of claim 22 wherein said central bore is roughened.

25. The mine roof bolt of claim 15 wherein said drive head abuts said barrel and wedge assembly and wherein said drive head extends less than one inch beyond said barrel and wedge assembly.

* * * * *

UNITED STATES PATENT AND TRADEMARK OFFICE
Certificate

Patent No. 5,829,922 Patented: November 3,1998

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Frank Calandra, Jr., Pittsburgh, PA (US); Eugene H. Stewart, Pittsburgh, PA (US); Stanley Ponce, Cresson, PA (US); John G. Oldsen, Butler, PA (US); John C. Stankus, Canonsburg, PA (US); and Robert Nestor, Albright, WV (US).

Signed and Sealed this Sixteenth Day of June 2009.

DAVID J. BAGNELL
*Supervisory Patent Examiner*
Art Unit 3672